United States Patent [19]

Okupniak

[11] 4,347,829

[45] Sep. 7, 1982

[54] ARCHERY BOW AND ARROW GUIDE SUPPORT AND ADJUSTMENT MEANS

[76] Inventor: Rudolf Okupniak, Gerokstrasse 55, D-7080 Aalen, Fed. Rep. of Germany

[21] Appl. No.: 119,550

[22] Filed: Feb. 7, 1980

[30] Foreign Application Priority Data

Mar. 3, 1979 [DE] Fed. Rep. of Germany ..... 2938809

[51] Int. Cl.[3] ..... F41B 5/00

[52] U.S. Cl. ..... 124/24 R; 124/41 A

[58] Field of Search ..... 124/41 A, 35 R, 24 R, 124/88, 86, 23 R, 22

[56] References Cited

U.S. PATENT DOCUMENTS 3,108,584 10/1963 Coe ..... 124/24 R 3,757,764 9/1973 Ikeya ..... 124/41 A 3,871,352 3/1975 Stanislawski et al. ..... 124/41 A

*Primary Examiner*—Richard C. Pinkham

*Assistant Examiner*—William R. Browne

[57] ABSTRACT

The disclosure concerns an archery bow and particularly the guiding elements on the bow for guiding the positioning of an arrow for shooting. The guiding elements include one element for laterally guiding the arrow handle and a second element for vertically positioning the arrow along the bowstring. Both of the guiding elements are supported on a supporting plate. The supporting plate is carried on a rail. The rail is shiftable with respect to the handle of the bow generally along the direction of the axis of the arrow. The supporting plate is shiftable vertically of the rail.

4 Claims, 4 Drawing Figures

ARCHERY BOW AND ARROW GUIDE SUPPORT AND ADJUSTMENT MEANS

BACKGROUND OF THE INVENTION

The invention refers to a bow for shooting an arrow, particularly a bow for archery or for hunting. The invention particularly relates to such a bow with a handle riser or handle section and with arrow guiding elements fitted to the handle section. The guiding elements including a lateral guide or side rest for the arrow and a support for vertical guidance of the arrow. Such bows have been described in the May 1978 Edition of "Archery World", page 75.

Known bows of this type generally have their guiding elements fitted directly and rigidly to the handle section. See U.S. Pat. No. 3,757,764. Therefore, considerable dexterity is required to put the arrows into the arrow guiding elements to place them against the bow string so as to locate each time as far as possible the so-called "center of energy". It is vital for an archer to be able to exactly predict the trajectory of an arrow. Locating the center of energy requires that the arrow rest against the bow string at the nock in such a way and such a location that the draw forces of both the upper and lower limbs of the bow are equal and that the best angle, for the desired trajectory of the arrow, between the axis of the arrow and the resultants of the two draw forces is properly adjusted. To facilitate this, marks, for example, in the form of little metal rings, are fitted to the string for indicating where the arrow should be placed. However, this enables only a relatively rough adjustment of the axis of the arrow.

In order to obtain a finer adjustment of the axis of the arrow, the arrow support, which serves for its vertical guidance, is height adjustable. Often, the side rest or bearing, which serves for lateral guidance of the arrow, is defined by the face of a plunger, which can be moved transversely across the axis of the arrow against a spring in a bore, in the handle section of the bow. However, following adjustment of the height of the support for the arrow, the axis of the arrow is no longer at the same height as the axis of the plunger. Since the arrow, when shot, acts with a transverse force against the plunger and moves the plunger to charge the spring, the plunger may be tilted in its bore when it is pushed by a transverse force that is applied eccentrically to the plunger. This results in incalculable friction forces. At the worst, it may even result in blocking of the motion of the plunger. At any rate, there is a risk that the arrow may deviate from its intended trajectory.

Furthermore, various arrow positioning means are known from U.S. Pat. Nos. 3,757,764 and 3,890,951. None of these provides easy adjustment of the guiding elements in both the vertical and arrow axis or horizontal directions.

SUMMARY OF THE INVENTION

It is an object of the invention to create a bow of the type described above, which provides for a fine adjustment of the axis of the arrow, but which bow does not have the drawbacks mentioned above.

According to the invention, the two arrow guide elements for vertical and lateral adjustments of the axis of the arrow are carried on a supporting plate and are adjustable relative to the handle section of the bow. An adjusting device on the handle section carries the supporting plate. The invention makes it possible for both the arrow side or lateral rest and the arrow vertical support to be always adjusted jointly.

The foregoing is achieved by shaping the handle section differently from that section of conventional bows. At the place where the arrow guide elements had been fitted to a conventional handle section, there is now an opening or a free space. The supporting plate for the arrow guide elements is arranged in that space so that it can be adjusted in relation to the handle section. The adjusting device constitutes the link between the handle section and the supporting plate.

The supporting plate can be made in such a way that it is:

(a) only height adjustable, allowing for a fine adjustment, as described above, of the location of the nock of the arrow along the bowstring; or (b) adjustable only in the direction of the axis of the arrow, thus making it possible for the archer to select his favorite position for the arrow guide elements in relation to the so-called "pivot point" or vertical rotation axis of the bow. The vertical rotation axis of the bow, as seen in a lateral view, goes through the center of the arrow side rest, and as much as possible, through the deepest point, as seen in the shooting direction, of the hand grip; or (c) adjustable both in height and in the direction of the arrow axis, i.e. (a) and (b) together.

The foregoing and other objects and features of the invention will be apparent from the following description and accompanying drawings.

DESCRIPTION OF A PRIOR ART EMBODIMENT

Figure 1:
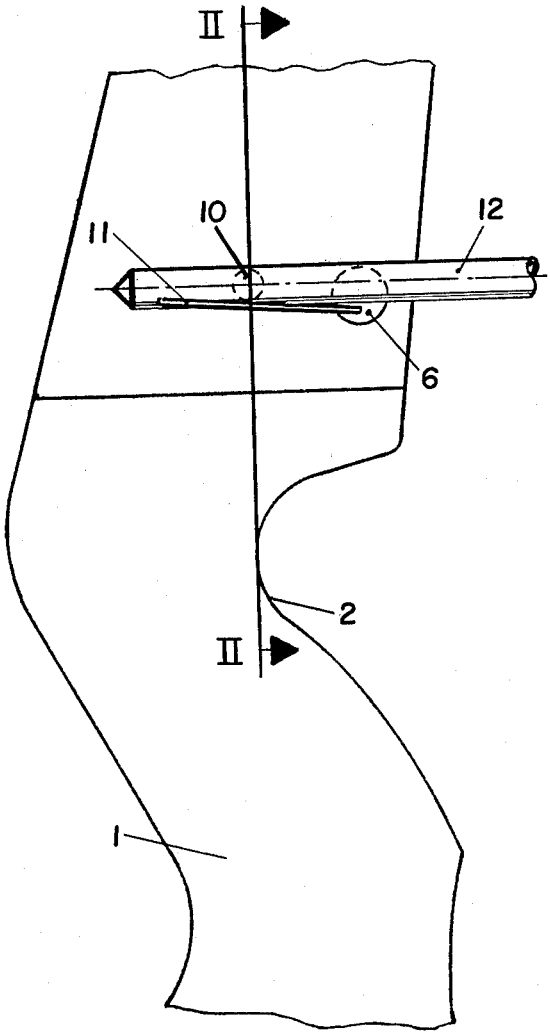
FIG. 1 PRIOR ART
FIG. 1 is a partial lateral view of a conventional handle riser or handle section with fixed arrow guide elements.
Figure 2:
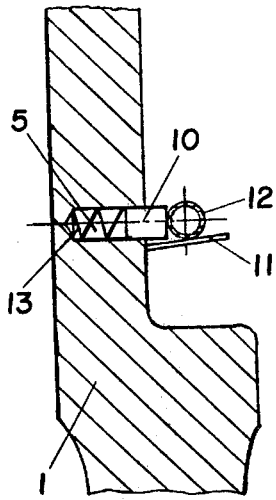
FIG. 2 PRIOR ART
FIG. 2 is a section along line II—II of FIG. 1.

FIGS. 1 and 2 show the vertical middle portion of a handle section 1 of a conventional bow with hand grip 2 and arrow guide elements 10 and 11. An arrow 12 is in the ready position to shoot. The arrow guide elements include an arrow support 11, which is comprised of a piece of wire fixed to the handle section by means of a round insert 6, and an arrow side rest, which is comprised of a cylindrical bolt or plunger 10. The plunger 10 seats in a bore 5 located in the handle section at the arrow receiving side of the bow and the plunger extends transversely to the axis of the arrow 12. The plunger 10 is movable in the bore 5 against a coil compression spring 13 in the bore 5. In FIG. 1, the section line II—II is at the rotation axis of the bow, and it goes through the center of the arrow side rest 10 and the deepest point of the grip 2.

DESCRIPTION OF A PREFERRED EMBODIMENT OF THE INVENTION

Figure 3:
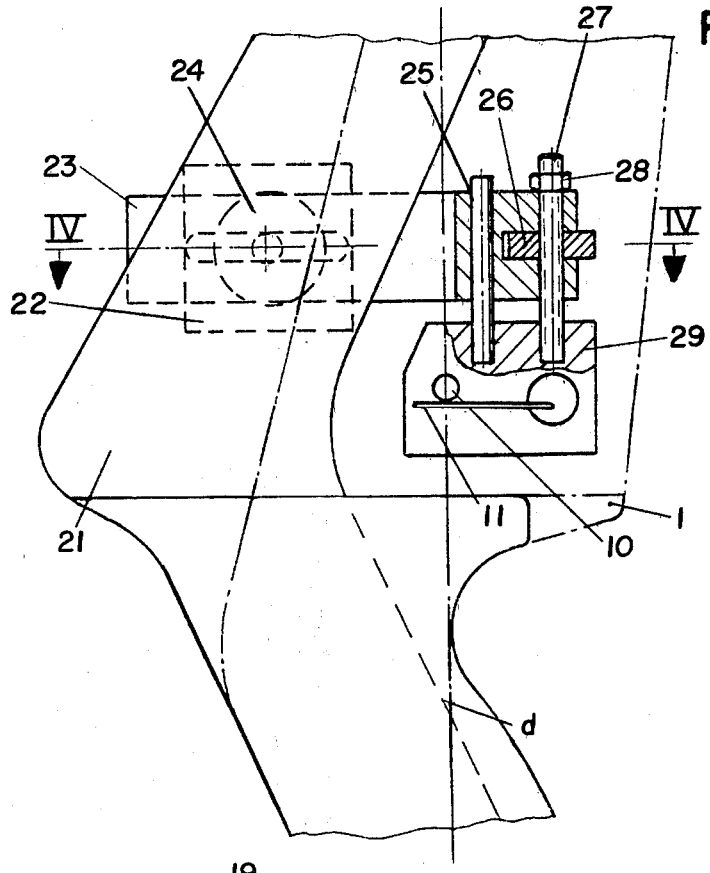
FIG. 3 is a lateral partial view of a handle section according to the invention, showing a partial sectional view of the adjusting device.
Figure 4:
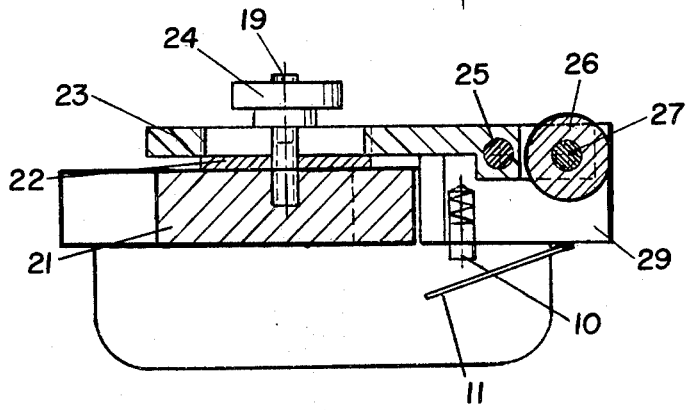
FIG. 4 is a section along the line IV—IV of FIG. 3.

In FIGS. 3 and 4, the handle section 21 according to the invention is shown. In order to emphasize the design of the handle section 21, as compared to the conventional handle section 1 according to FIGS. 1 and 2, the latter handle section 1 has been marked in FIG. 3 in phantom in a dot-and-dash pattern and it is shown overlaid on the inventive handle section 21. As compared to FIGS. 1 and 2, the design of the arrow guide elements 10 and 11 remains unchanged. But, they are now located on a supporting plate 29, which is connected to the handle section 21 by means of an adjusting device.

The handle section 21 carries a fixed support 22. This support has a recess defined in its outward face in which a rail 23 is movably fitted. The rail 23 can be adjusted through the recess in support 22 along a pathway generally parallel to the axis of an arrow positioned for shooting from the bow. Movement of the rail 23 can be blocked by a knurled nut 24 which can be tightened down against rail 23 by hand, and which is arranged on a threaded pin 19 that is received in a threaded opening in the section 21.

The supporting plate 29 is supported by the rail 23 and carries both the arrow side rest 10 and the arrow support 11. The supporting plate 29 is adjustable in the vertical directions. This is achieved by a threaded bolt 27, which is rigidly connected up to the supporting plate 29, and by a cylindrical guide pin 25 which may be rigid in support plate 29 and be shiftable axially of itself in rail 23. Both elements 25 and 27 extend parallel to each other and in a vertical direction through clearance bore holes in the rail 23. Partway along the length of the bore hole for the threaded pin 27, the rail 23 has a recess for another knurled nut 26. The nut 26 extends out of the rail 23 toward the archer. When the nut 26 is turned by hand, the threaded pin 27 along with the attached supporting plate 29 are together adjusted up or down. The supporting plate 29 can be locked in any selected vertical position by a counter nut 28, which is tightened down along the shaft 27 against the top of the rail 23.

In view of the arrangement of the two arrow guide elements 10 and 11 on the adjustable supporting plate 29, it is necessary to form the handle section 21 in a different way than is done with conventional bows. This means that the arrow side rest 10 still remains within the range of the vertical rotation axis d of the bow, i.e., it may be shifted with supporting plate 29 to be at or slightly offset from, the vertical rotation axis d of the bow. One may say that the handle section 21 has to be constructed around the supporting plate 29. In FIG. 3, the handle section 21 as seen against the line of shooting, is fully in front of the supporting plate 29, i.e., the rear of the grip of the handle section is forward of the plate 29. However, other forms for the handle section 21 are possible. For example, it could well extend sideways past the supporting plate 29. This means that the handle section could, when seen sideways (according to FIGS. 1 or 3), retain to a large extent its conventional form of FIG. 1. However, the so-called sight window would then have to be placed relatively far aside the handle section. Therefore, it would be preferred to have the handle section pass by both sides of the supporting plate. This means that the sight window is made of two straps, thus creating a center opening.

Although the present invention has been described in connection with a preferred embodiment thereof, many variations and modifications will now become apparent to those skilled in the art. It is preferred, therefore, that the present invention be limited not by the specific disclosure herein, but only by the appended claims.

What is claimed is:

1. An archery bow, comprising:

a handle section;

arrow guide elements supported by said handle section and including bearing means for lateral positioning of an arrow with respect to said handle section and a support for the vertical guidance of the arrow;

a supporting plate having both said arrow guide element arranged thereon;

adjusting means joining said supporting plate to said handle section and being adjustable for moving said support plate with respect to said handle section, said adjusting means being adjustable for adjusting said support plate generally along the direction of the axis of an arrow that may be supported in position for shooting by the bow, said adjusting means including a rail attached to said handle section and extending generally in the direction of the axis of an arrow being supported by the bow for shooting, said supporting plate being carried on said rail for enabling movement of said support plate generally along the direction of the axis of an arrow being supported by the bow for shooting; and a space being defined on said handle section for receiving said supporting plate and for submitting adjustment movement of said support plate with respect to said handle section.

2. The archery bow of claim 1, further comprising guiding elements on said supporting plate and joining said supporting plate to said rail for enabling said supporting plate to be moved vertically of said rail.

3. The archery bow of claim 2, wherein said guiding elements comprise shaft means extending between said supporting plate and said rail and extending generally vertically of the archery bow and into the rail.

4. The archery bow of any one of claims 1, 2 or 3, wherein said supporting plate is movable generally along the axis of an arrow by means of said rail being movable with respect to said handle section generally along that axis.

* * * * *